US006799981B1

(12) United States Patent
Yu

(10) Patent No.: US 6,799,981 B1
(45) Date of Patent: Oct. 5, 2004

(54) ADAPTER STRUCTURE FOR COMPUTER CONNECTOR

(76) Inventor: Chun Te Yu, No. 41-21, Kuan-Tsui St., Hsia-Nien Tsun, Fu-Hsing Hsiang, Changhua County (TW)

( * ) Notice: Subject to any disclaimer, the term of this patent is extended or adjusted under 35 U.S.C. 154(b) by 0 days.

(21) Appl. No.: 10/660,648

(22) Filed: Sep. 12, 2003

(30) Foreign Application Priority Data

Jul. 21, 2003 (TW) ..... 092213324

(51) Int. Cl.[7] ..... H01R 13/44
(52) U.S. Cl. ..... 439/133; 439/304; 439/362; 439/639; 439/638
(58) Field of Search ..... 439/133, 304, 439/638, 639, 362

(56) References Cited

U.S. PATENT DOCUMENTS 3,963,300 A * 6/1976 Patton et al. ..... 439/638
4,669,281 A * 6/1987 Young ..... 439/133
5,192,226 A * 3/1993 Wang ..... 439/639
5,212,729 A * 5/1993 Schafer ..... 439/639
5,430,618 A * 7/1995 Huang ..... 439/47
6,522,532 B2 * 2/2003 Liao et al. ..... 439/133
6,729,897 B2 * 5/2004 Lai ..... 439/133
2003/0045171 A1 * 3/2003 Tupper ..... 439/639
2003/0194910 A1 * 10/2003 Stoner et al. ..... 439/638
2003/0224637 A1 * 12/2003 Ling ..... 439/133

* cited by examiner

*Primary Examiner*—Tho D. Ta
(74) *Attorney, Agent, or Firm*—Troxell Law Office PLLC

(57) ABSTRACT

An adapter structure for computer connector, which is connectable between a connecting port of a computer and a burglarproof lock. The adapter structure includes a main body. A front adaptation end is disposed on an end face of the main body. The front adaptation end has multiple conductive terminals for electrically connecting with the connecting port of the computer. A connecting end is disposed on a wall face of the main body and connectable with the burglarproof lock. Through holes are formed on two sides of the main body, permitting bolts or threaded sections of the burglarproof lock to pass therethrough. An electric output end is disposed on the main body and has a carrier section and locking sections on two sides thereof. The carrier section is formed with multiple sockets electrically connected with the conductive terminals of the front adaptation end. The electric output end is selectively connectable with a connector of a computer transmission system.

17 Claims, 9 Drawing Sheets

ADAPTER STRUCTURE FOR COMPUTER CONNECTOR

BACKGROUND OF THE INVENTION

The present invention is related to an adapter structure for computer connector, which is connectable between a connecting port of a computer and a burglarproof lock. The adapter structure can be blocked by the burglarproof lock or provide a distribution function.

Nowadays, portable computers are widely used in various fields such as personal data processing, information link and transmission, etc. Such portable computers are apt to be thieved by unauthorized persons. Therefore, many burglarproof locks for the portable computers have been developed for preventing the portable computers from being stolen. For example, Taiwanese Patent No. 87220494 discloses a numeral lock including a locking bolt which can be inserted in a hole or slot of an article. Taiwanese Patent No. 87205390 discloses a lock for portable computer. Taiwanese Patent No. 89201937 discloses a burglarproof lock for a computer. In the above Patents, a locking bolt or hook is reciprocally movably extended into a hole or slot of the portable computer to lock the computer so as to prevent the computer from being stolen.

FIG. 1 shows another type of burglarproof lock for a computer. The burglarproof lock 10 has a connecting section 12 which can be inserted with a connecting port of a computer to block the same. The burglarproof lock 10 further has an adjustment press button 11 which is axially movable and rotatable. A bolt or threaded section 13 of the adjustment press button 11 can be screwed into the thread hole on each side of the connecting port. The adjustment press button 11 can be pressed into the housing of the burglarproof lock. Only when every numeral wheels 14 are turned to the set numbers, the adjustment press button 11 is bounded out of the housing. Therefore, when a user leaves a portable computer, the burglarproof lock can be locked with the connecting port of the portable computer to prevent the computer from being stolen. Also, an unauthorized person cannot plug any connector into the connecting port of the computer to thieve confidential data. However, when the connecting port is blocked by the burglarproof lock, the peripheral equipment of the computer such as a printer and a projector or another computer cannot be connected with the connecting port of the computer.

SUMMARY OF THE INVENTION

It is therefore a primary object of the present invention to provide an adapter structure for computer connector, which is connectable between a connecting port of a computer and a burglarproof lock. A connecting end or an electric output end of the adapter can be selectively blocked by the burglarproof lock. When only the connecting end of the adapter is blocked, the electric output end of the adapter can be connected with a computer transmission system.

According to the above object, the adapter structure for the computer connector of the present invention includes a main body having a housing. A front adaptation end is disposed on an end face of the main body and connectable with the connecting port of the computer. The front adaptation end has multiple conductive terminals for electrically connecting with the connecting port of the computer. A connecting end is disposed on a wall face of the main body and connectable with the burglarproof lock. Through holes are formed on the main body, permitting bolts or threaded sections of the burglarproof lock to pass therethrough and lock in thread holes on two sides of the connecting port of the computer. An electric output end is disposed on the main body and has a carrier section and locking sections on two sides thereof. The carrier section is formed with multiple sockets electrically connected with the conductive terminals of the front adaptation end. The electric output end is selectively connectable with a connector of a peripheral equipment of the computer, such as a printer, a projector or other computer communication system. Alternatively, the electric output end can be blocked by an identical burglarproof lock.

A bolt having a socket can be disposed in each through hole of the adapter. The bolt has a front section for locking in the thread hole beside the connecting port of the computer. The socket of the bolt outward protrudes from the through hole of the adapter, whereby the bolts or threaded sections of the burglarproof lock are lockable in the sockets of the bolts.

The present invention can be best understood through the following description and accompanying drawings wherein:

DETAILED DESCRIPTION OF THE PREFERRED EMBODIMENTS

Figure 1A:
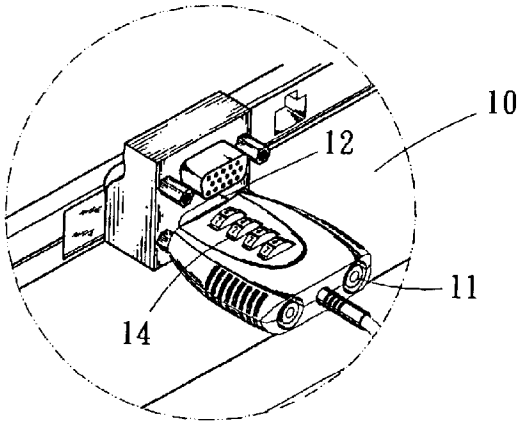
FIG. 1A is an enlarged view of circled area A of FIG. 1.
Figure 1:
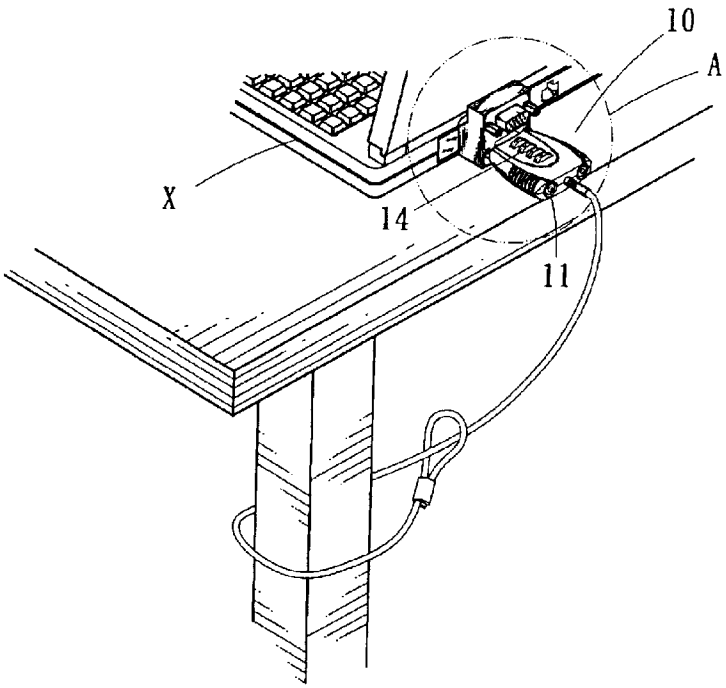
FIG. 1 is a perspective view of a burglarproof lock for a portable computer.
Figure 2:
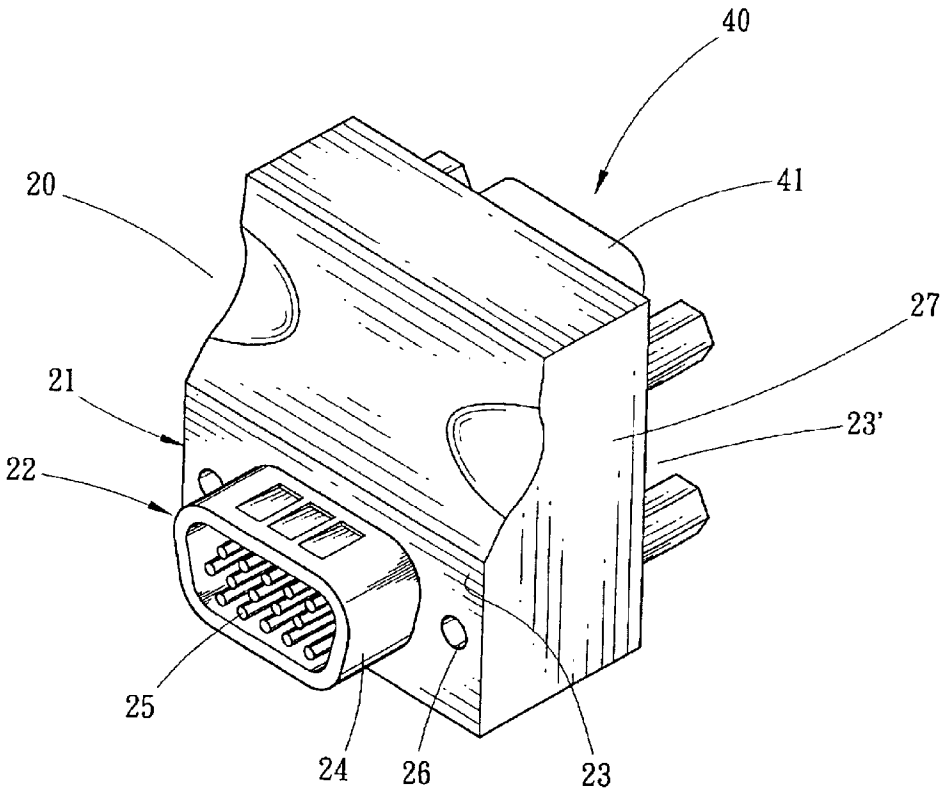
FIG. 2 is a perspective view of the adapter of the present invention.
Figure 3:
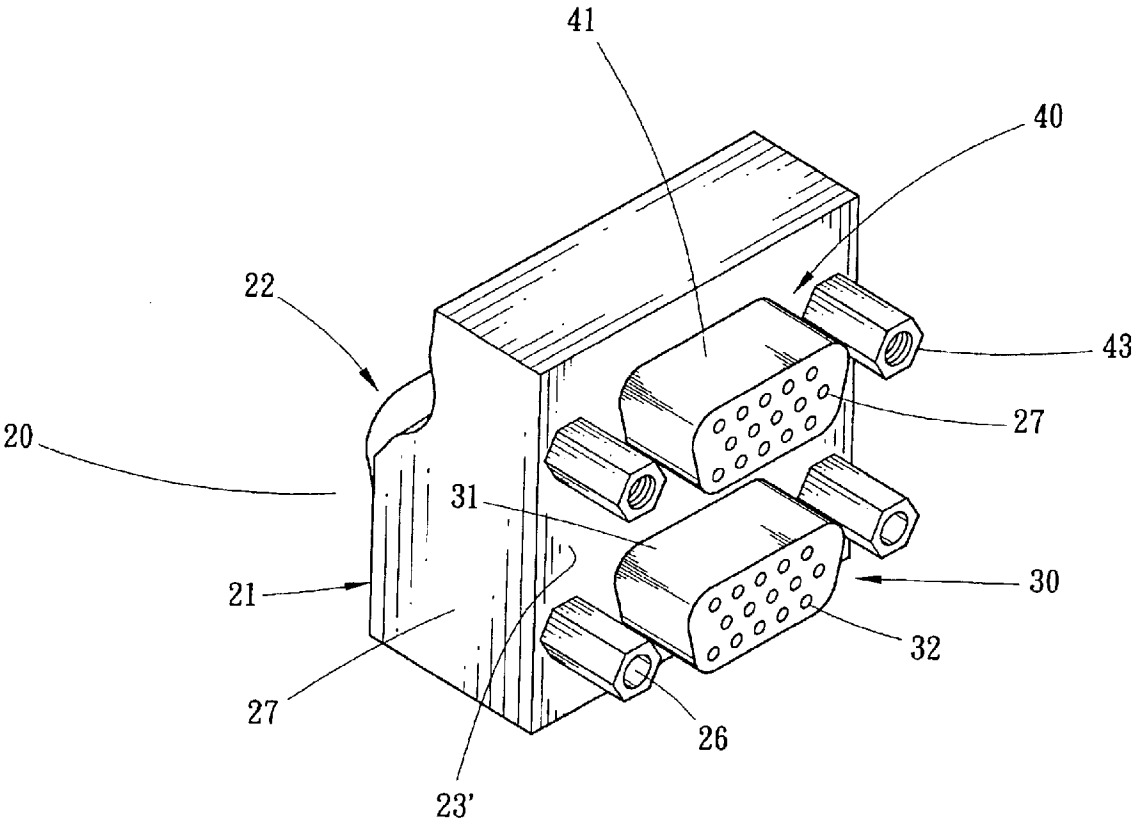
FIG. 3 is a perspective view of the adapter of the present invention, seen in another direction.

Please refer to FIGS. 2 and 3. The adapter of the present invention includes a main body 20 having a housing 21. A front adaptation end 22 horizontally protrudes from an end face 23 of the main body 20. The front adaptation end 22 has a shielding section 24 and multiple conductive terminals 25 enclosed in the shielding section 24. The front adaptation end 22 can be connected with a connecting port of a computer. A connecting end 30 is disposed on a wall face 23' of the main body 20 opposite to the end face 23. The connecting end 30 is aligned with the front adaptation end 22 and horizontally arranged in a direction reverse to the front adaptation end 22. The connecting end 30 includes a carrier section 31 for connecting with the connecting section 12 of the burglarproof lock 10 of FIG. 1 by insertion. The carrier section 31 is formed with multiple sockets electrically connected with the conductive terminals 25 of the front adaptation end 22. Two through holes 26 are formed on two sides of the front adaptation end 22. The through holes 26 extend from the end face 23 to the wall face 23', permitting the bolts or threaded sections 13 of the burglarproof lock 10 to pass therethrough.

Referring to FIG. 3, an electric output end 40 is disposed on the wall face 23' of the main body above the connecting end 30. The electric output end 40 has a carrier section 41 and two locking sections 43 on two sides thereof. The carrier section 41 is formed with multiple sockets 42 electrically connected with the conductive terminals 25. A connector of other computer transmission system can be connected with the carrier section 41.

Figure 4:
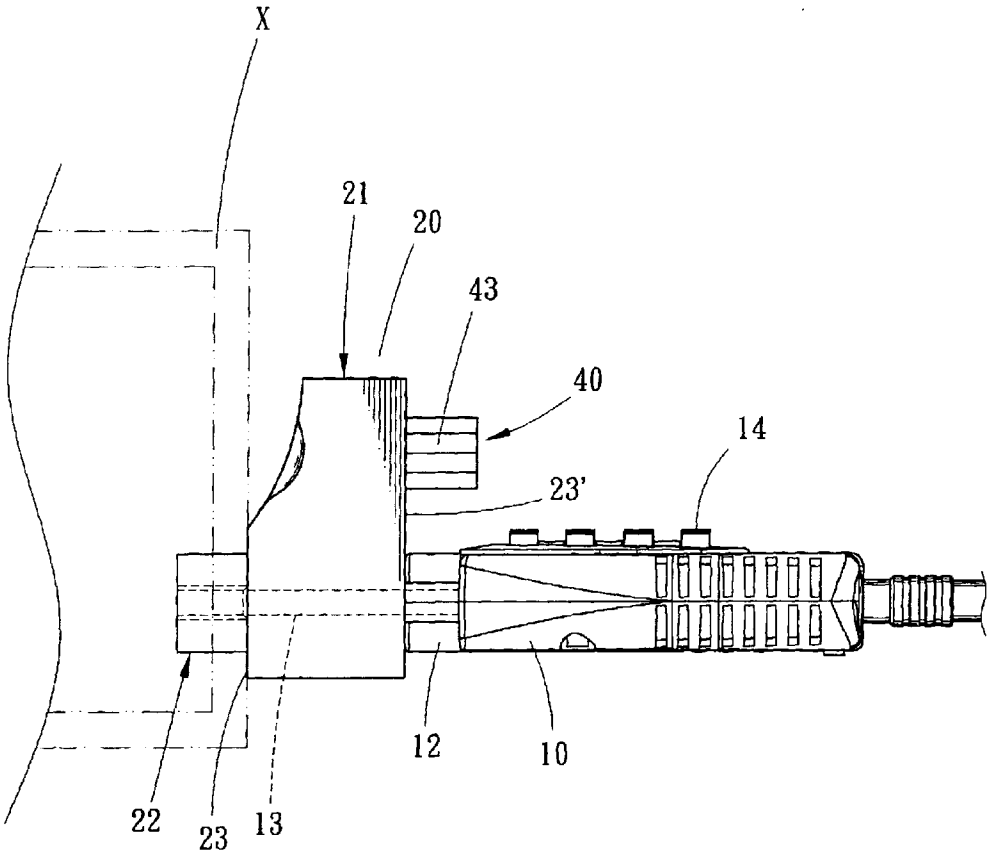
FIG. 4 shows that the adapter of the present invention is co-used with the burglarproof lock of FIG. 1.

FIG. 4 shows the application of the adapter of the present invention. The front adaptation end 22 is inserted with a connecting port of a portable computer x, whereby the conductive terminals 25 are electrically connected with the connecting port. The connecting section 12 of the burglarproof lock 10 is fitted on the carrier section 31 of the connecting end 30. The bolts or threaded sections 13 of the burglarproof lock 10 are passed through the through holes 26 and extended out. By means of turning the adjustment press buttons 11, the bolts or threaded sections 13 are screwed into the thread holes on two sides of the connecting port. Accordingly, when a user leaves the portable computer x, the portable computer is prevented from being stolen.

Figure 5:
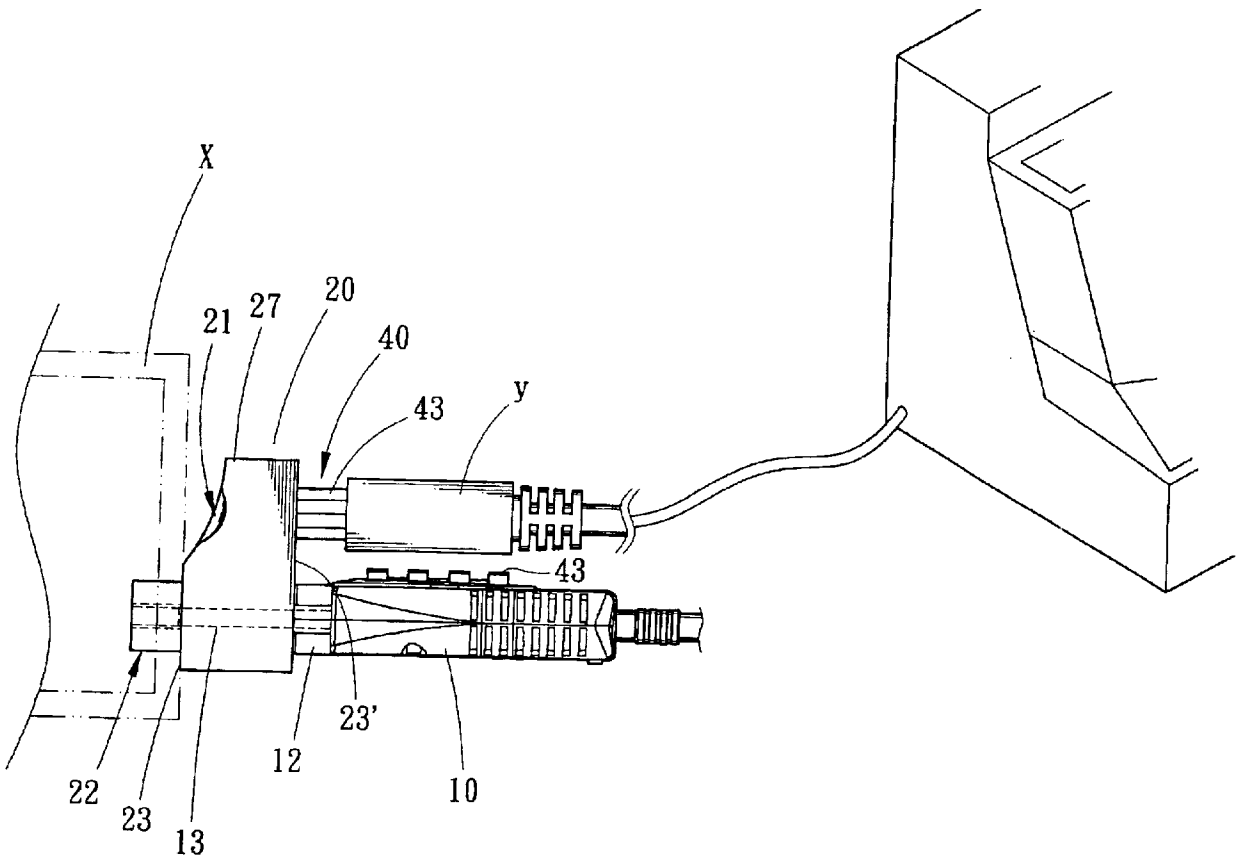
FIG. 5 shows that the electric output end of the adapter of the present invention is connected with a connector of an image display.

FIG. 4 shows that the electric output end 40 is exposed to outer side and a connector y of other computer transmission system can be connected with the electric output end 40. For example, a connector y of a printer or a projector can be inserted in the electric output end 40 as shown in FIG. 5. Alternatively, the electric output end 40 can be blocked by an identical burglarproof lock. When the connecting end 30 is not blocked by the burglarproof lock 10, a connector y of another printer, projector or image display can be connected with the connecting end 30.

Figure 6:
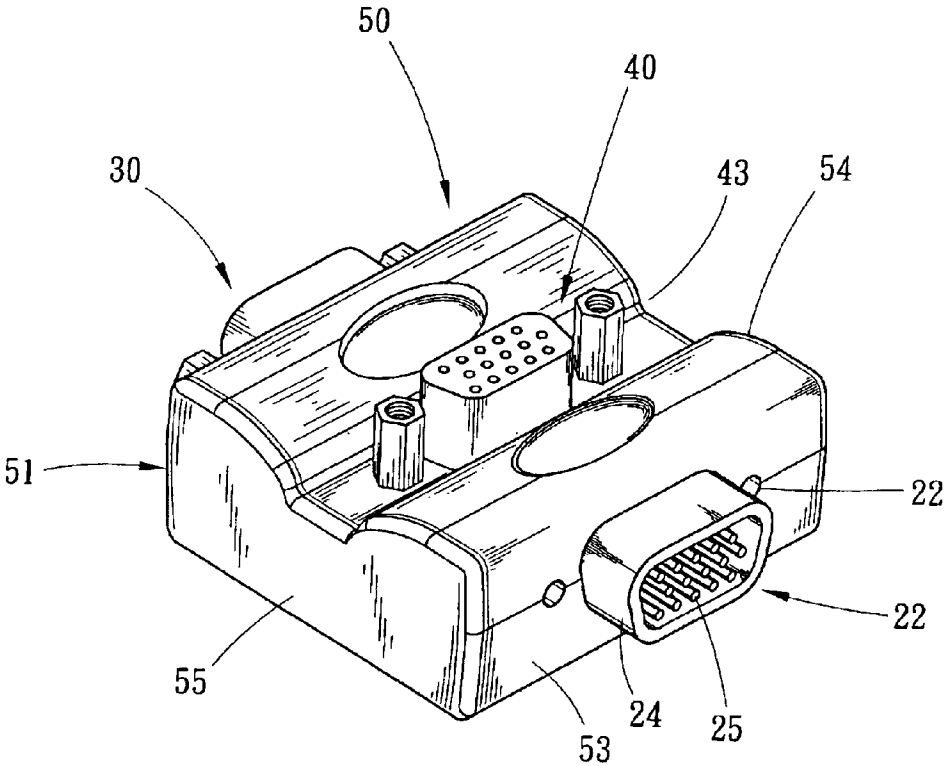
FIG. 6 is a perspective view of another embodiment of the adapter of the present invention.

FIG. 6 shows a modified embodiment of the adapter 50 of the present invention. The through holes 56 extend from the end face 51 of the adapter 50 to the wall face 53. The front adaptation end 22 and the connecting end 30 are horizontally aligned with each other for respectively connecting with a connecting port of a computer and the connecting section 12 of the burglarproof lock. The electric output end 40 is disposed on the top face 54 of the adapter 50 for connecting with a connector y of a printer, a projector or other computer communication system. Alternatively, the electric output end 40 can be disposed on a lateral face 27, 57 of the adapter 20, 50.

Figure 7:
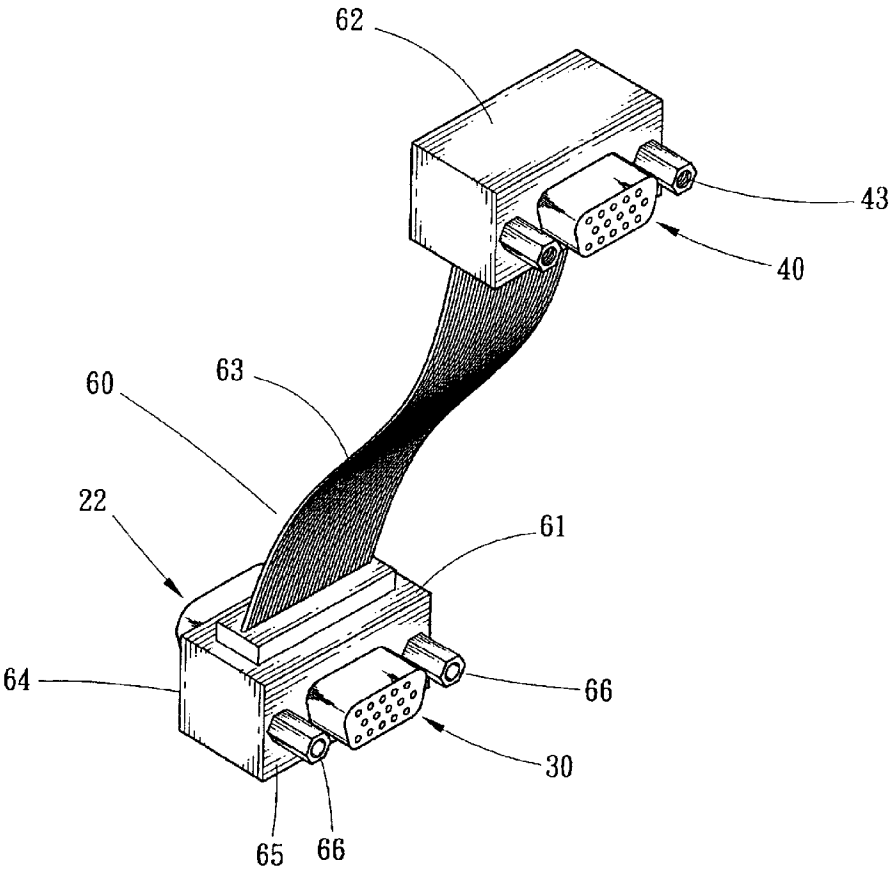
FIG. 7 is a perspective view of still another embodiment of the adapter of the present invention.

FIG. 7 shows another modified embodiment of the adapter 60 of the present invention. The adapter 60 includes a first main body 61, a second main body 62 and a signal line 63 electrically connected between the first and second main bodies 61, 62. The front adaptation end 22 and the connecting end 30 are respectively disposed on two opposite end faces 64, 65 of the first main body 61. The through holes 66 are formed on two sides of the front adaptation end 22 and the connecting end 30 and extend from the end face 64 of the first main body 61 to the other end face 65 thereof, permitting the bolts or threaded sections 13 of the burglarproof lock 10 to pass therethrough. The electric output end 40 and locking sections 43 are formed on the second main body 62. The electric output end 40 is connectable with a connector y of a printer and a projector. Alternatively, the electric output end 40 can be blocked by an identical burglarproof lock 10.

Figure 8:
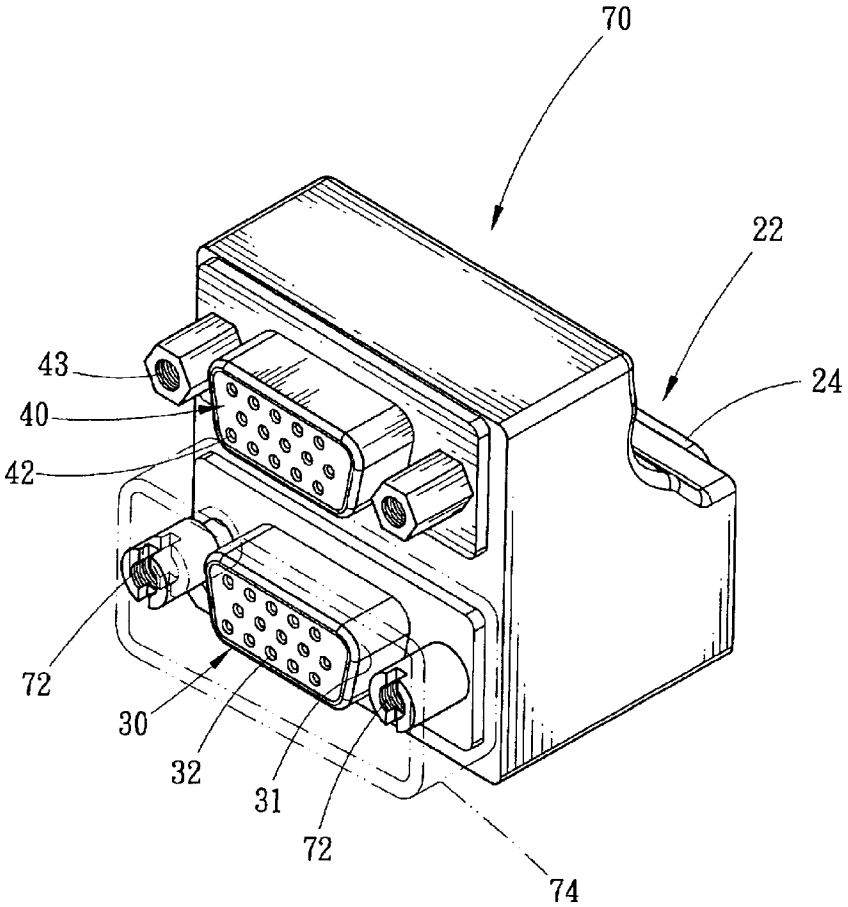
FIG. 8 is a perspective view of still another embodiment of the adapter of the present invention.
Figure 9:
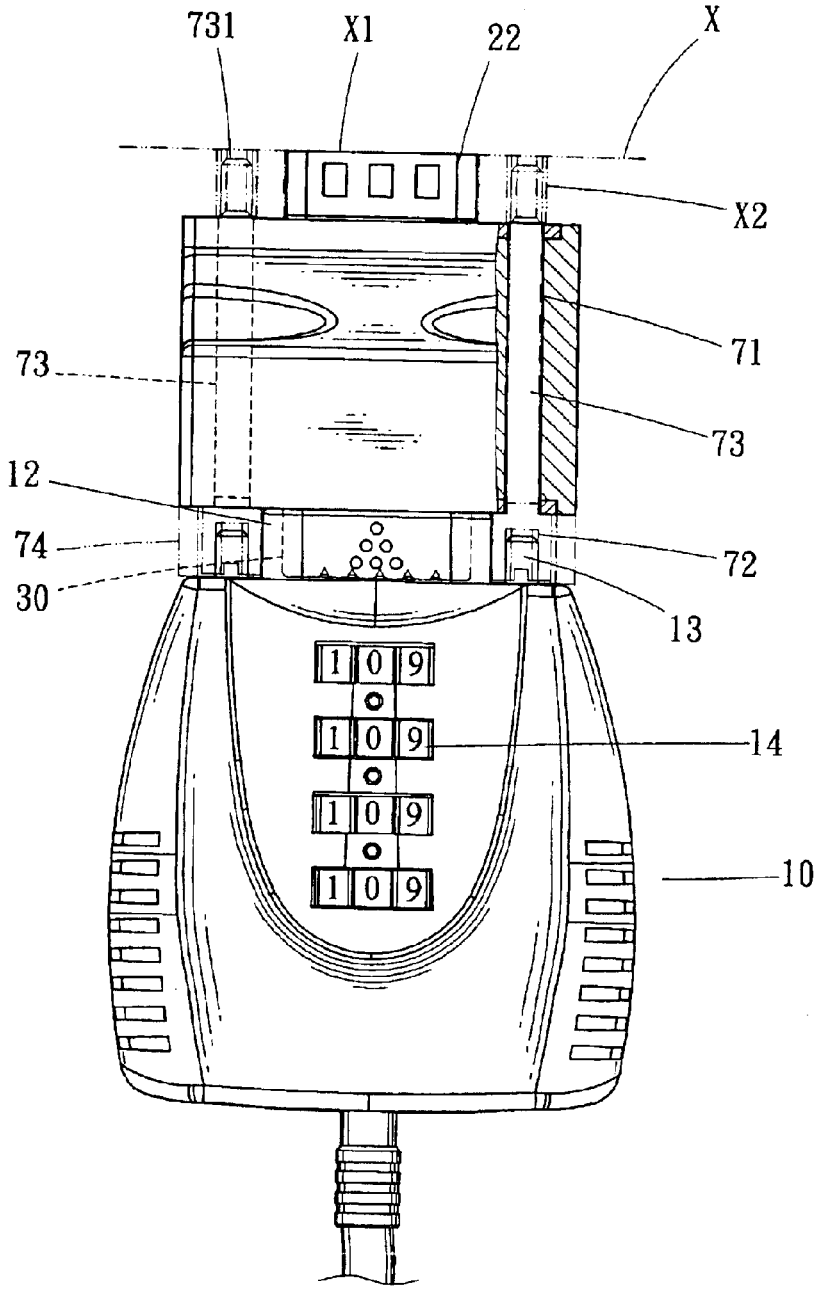
FIG. 9 shows that the adapter of FIG. 8 is co-used with the burglarproof lock and connected with the connecting port of the computer.

FIGS. 8 and 9 show still another modified embodiment of the adapter 70 of the present invention. Each through hole 71 of the adapter 70 is equipped with a bolt 73 having a socket 72. An end section of the bolt 73 outward protruding from each side of the connecting end 30 has a cylindrical or polygonal configuration. When the front adaptation end 22 of the adapter 70 is inserted with the connecting port x1 of the computer, the bolts 73 are rotated to make the front sections 731 locked in the thread holes x2 on two sides of the connecting port. Accordingly, when the connecting section 12 of the burglarproof lock 10 is inserted with the connecting end 30 of the adapter 70, the bolts or threaded sections 13 of the burglarproof lock 10 are locked in the sockets 72 as shown in FIG. 9. A shielding body 74 can be disposed on one face of the adapter 70 to enclose the sockets 72 protruding from the through holes 71. Therefore, the assembly of the bolts or threaded sections 13 of the burglarproof lock 10 and the sockets 72 are enclosed in the shielding body 74.

According to the above arrangements, the adapters 20, 50, 60, 70 of the present invention have the following characteristics and advantages:

1. The conductive terminals 25 enclosed in the shielding section 24 of the front adaptation end 22 form a male member to be inserted into a female member of the connecting port of the computer. In accordance with such cooperation relationship, the carrier sections 31, 41 of the connecting end 30 or the electric output end 40 are preferably formed with sockets 32, 42.
2. The through holes 26, 56, 66 extend through the adapters 20, 50, 60, permitting the bolts or threaded sections 13 of the burglarproof lock 10 to pass therethrough for locking in the thread holes on two sides of the connecting port of the computer.
3. The front adaptation end 22, connecting end 30 and electric output end 40 can be arranged on the adapters 20, 50, 60 in different positions. Moreover, as shown in FIGS. 6 and 7, the configuration of the adapters 20, 50, 60 are modifiable.
4. The carrier section 31 of the connecting end can be formed with the sockets 32 or free from the sockets 32. In the case that the carrier section 31 of the connecting end is formed with the sockets 32, when the connecting end is not blocked by the burglarproof lock 10, the connector of a printer, a projector or the like can be inserted in the connecting end.
5. FIGS. 8 and 9 show that the bolt 73 is disposed in the through hole 71 of the adapter 70. The bolts or threaded sections 13 of the burglarproof lock 10 can be locked in the sockets 72 of the bolts 73 to form a two-stage structure. Such structure is modifiable.
6. The adapters 20, 50, 60 are co-used with the burglarproof lock 10 of FIG. 1 for locking the portable computer x. When user leaves the portable computer x, the portable computer is prevented from being stolen. In addition, the adapters 20, 50, 60 provide at least one connecting end 30 or electric output end 40 for a user to selectively externally connect with a connector of a printer or a projector. Alternatively, the connecting end 30 or electric output end 40 can be blocked by an identical burglarproof lock.

The above embodiments are only used to illustrate the present invention, not intended to limit the scope thereof. Many modifications of the above embodiments can be made without departing from the spirit of the present invention.

What is claimed is:

1. An adapter structure for computer connector, the adapter structure being connectable between a connecting port of a computer and a burglarproof lock, comprising:

a main body;

a front adaptation end disposed on an end face of the main body and connectable with the connecting port of the computer, the front adaptation end having multiple conductive terminals for electrically connecting with the connecting port of the computer;

a connecting end disposed on a wall face of the main body and connectable with the burglarproof lock;

through holes formed on the main body, permitting bolts or threaded sections of the burglarproof lock to pass therethrough and lock in thread holes on two sides of the connecting port of the computer; and an electric output end disposed on the main body and having a carrier section and locking sections on two sides thereof, the carrier section being formed with multiple-sockets electrically connected with the conductive terminals of the front adaptation end, the electric output end being selectively connectable with a connector of a peripheral equipment of the computer.

2. The adapter structure for the computer connector as claimed in claim 1, wherein the front adaptation end and the connecting end are horizontally disposed on the main body and aligned with each other, the connecting end being arranged in a direction reverse to that of the front adaptation end.

3. The adapter structure for the computer connector as claimed in claim 1, wherein the front adaptation end includes a shielding section enclosing the conductive terminals.

4. The adapter structure for the computer connector as claimed in claim 1, wherein the electric output end is disposed on top wall of the main body.

5. The adapter structure for the computer connector as claimed in claim 1, wherein the connecting end has a carrier section.

6. The adapter structure for the computer connector as claimed in claim 5, wherein the carrier section of the connecting section is formed with multiple sockets electrically connected with the conductive terminals of the front adaptation end.

7. The adapter structure for the computer connector as claimed in claim 1, wherein the main body of the adapter includes a first main body, a second main body and a signal line electrically connected between the first and second main bodies.

8. The adapter structure for the computer connector as claimed in claim 1, wherein the front adaptation end and the connecting end are respectively disposed on two end faces of the first main body, the through holes being formed on two sides of the front adaptation end and the connecting end and extending between the two end faces of the first main body.

9. The adapter structure for the computer connector as claimed in claims 8, wherein the electric output end and the locking sections are arranged on the second main body.

10. The adapter structure for the computer connector as claimed in claim 7, wherein the front adaptation end and the connecting end are respectively disposed on two end faces of the first main body, the through holes being formed on two sides of the front adaptation end and the connecting end and extending between the two end faces of the first main body.

11. The adapter structure for the computer connector as claimed in claim 10, wherein the electric output end and the locking sections are arranged on the second main body.

12. The adapter structure for the computer connector as claimed in claim 1, wherein a bolt having a socket is disposed in each through hole of the adapter, the bolt having a front section for locking in the thread hole beside the connecting port of the computer.

13. The adapter structure for the computer connector as claimed in claim 12, wherein the bolts or threaded sections of the burglarproof lock are lockable in the sockets of the bolts disposed in the through holes.

14. The adapter structure for the computer connector as claimed in claim 12, wherein a shielding body is disposed on one face of the adapter, on which the connecting end is disposed, to enclose the sockets of the bolts.

15. The adapter structure for the computer connector as claimed in claim 12, wherein the socket of the bolt outward protrudes from the through hole of the adapter.

16. The adapter structure for the computer connector as claimed in claim 15, wherein the bolts or threaded sections of the burglarproof lock are lockable in the sockets of the bolts disposed in the through holes.

17. The adapter structure for the computer connector as claimed in claim 15, wherein a shielding body is disposed on one face of the adapter, on which the connecting end is disposed, to enclose the sockets of the bolts.

* * * * *